US007097073B2

(12) United States Patent
Zimmerman

(10) Patent No.: US 7,097,073 B2
(45) Date of Patent: Aug. 29, 2006

(54) WATER GUN WITH ADJUSTABLE FORCE PRESSURE CHAMBER

(75) Inventor: Jeffrey C. Zimmerman, King of Prussia, PA (US)

(73) Assignee: Buzz Bee Toys, Inc., Mt. Laurel, NJ (US)

( * ) Notice: Subject to any disclaimer, the term of this patent is extended or adjusted under 35 U.S.C. 154(b) by 356 days.

(21) Appl. No.: 10/679,809

(22) Filed: Oct. 6, 2003

(65) Prior Publication Data

US 2005/0072794 A1 Apr. 7, 2005

(51) Int. Cl.
*A63H 3/18* (2006.01)

(52) U.S. Cl. ..... 222/79; 222/389; 222/401; 222/255

(58) Field of Classification Search ..... 222/79, 222/95, 173, 251, 396, 401, 465.1, 255, 389, 222/135

See application file for complete search history.

(56) References Cited

U.S. PATENT DOCUMENTS 3,578,789 A * 5/1971 Ferri ..... 222/79
4,214,674 A * 7/1980 Jones et al. ..... 222/79
4,239,129 A * 12/1980 Esposito ..... 222/79
5,238,149 A 8/1993 Johnson et al.
5,381,928 A 1/1995 Lee et al.
5,419,458 A 5/1995 Mayer
RE35,412 E 12/1996 Johnson et al.
5,662,244 A 9/1997 Liu et al.
5,779,100 A 7/1998 Johnson
5,826,750 A 10/1998 Johnson
5,865,344 A * 2/1999 Nagel ..... 222/79
5,878,735 A 3/1999 Johnson
5,878,914 A 3/1999 Johnson
6,203,397 B1 3/2001 Applewhite et al.
6,364,162 B1 4/2002 Johnson et al.
6,474,507 B1 11/2002 Hornsby et al.

* cited by examiner

*Primary Examiner*—Philippe Derakshani
(74) *Attorney, Agent, or Firm*—Volpe and Koenig, P.C.

(57) ABSTRACT

A toy water gun having a water supply tank which can be filled with water, and a water pump located on the housing for pumping water from the supply tank to at least one water pressure chamber. The water pressure chamber includes at least one fixed wall, and a moveable wall which substantially sealingly engages the at least one fixed wall and is slidable away from a first end wall as water is pumped into the water pressure chamber and toward the first end wall as water is discharged. An air pressure chamber located on an opposite side of the moveable wall from the water pressure chamber and is pressurizable with compressed air to bias the moveable wall toward the first end wall. An air pump is connected to the air pressure chamber for pressurizing the air pressure chamber with a user desired air pressure. Upon actuation of the release valve, the air pressure acts on the moveable wall to force water under pressure from the water pressure chamber so that a stream of water is ejected from the nozzle.

15 Claims, 3 Drawing Sheets

WATER GUN WITH ADJUSTABLE FORCE PRESSURE CHAMBER

BACKGROUND

The present invention is directed to a water gun and more particularly, to a water gun having a pressure chamber into which water is pumped and held under pressure for release from the water gun.

Toy water guns are known which utilize pressurized air or a pressurized bladder as the motive force for discharging water from the gun upon release of a nozzle valve. U.S. Pat. No. 4,135,559 describes a water toy and fill valve combination. The water toy includes a resiliently expandable tubular bladder which serves as the pressurized water reservoir and the motive member for discharging water from the gun. Pressurized water is loaded into the bladder via the fill valve combination such that the bladder expands due to water pressure of the water from the fill valve. A trigger is provided which is connected to a release valve is provided for allowing water to be ejected from the toy water gun.

U.S. Pat. No. 5,799,827 discloses a similar water gun having a tubular bladder arranged in a tubular holding member. A separate water tank is located on the gun which holds water at ambient pressure. A pump located on the gun is utilized to transfer water from the ambient pressure water tank into the bladder, expanding the bladder. Upon release of a nozzle valve, water is ejected from the toy gun.

U.S. Pat. No. 5,878,914 discloses a similar toy water gun utilizing a water tank with water at ambient pressure, a pump and a balloon-shaped bladder located in a bladder chamber. Specialized valving means are provided to allow air drawn in to the pump from the water reservoir to be pumped back into the reservoir instead of the bladder. An alternate type of pressure chamber is also described in which the pressure chamber is formed by a spring-loaded wall which can be compressed within a chamber.

A drawback with these types of arrangements is that it is difficult and costly to produce a tubular or balloon-shaped bladder economically and with the desired characteristics to provide for fluid discharge with a relatively constant pressure during the entire discharge operation. Additionally, the elastic constant for the bladder material slowly degrades with age and use so that the bladder loses some elasticity over time. In the case of a spring-loaded wall type pressure chamber, the spring relaxes over time and therefore performance drops.

Additionally, it is difficult to provide a single elastic constant for the bladder or spring constant for a sprung-walled chamber that allows for ease of use for both younger children, who have less strength to overcome the spring or elastic force to charge the pressure chamber, as well as higher performance for older children and teens who can apply more pumping force.

SUMMARY

Briefly stated, the present invention provides a toy water gun. The water gun includes a housing having a handle with a trigger as well as a barrel with a water ejection nozzle located thereon. A water supply tank is connected to the housing and can be filled with water. A water pump is preferably located on the housing for pumping water from the supply tank to at least one water pressure chamber. The water pressure chamber includes at least one fixed wall, a first end wall, and a moveable wall which substantially sealingly engages the at least one fixed wall and is slidable away from the first end wall as water is pumped into the water pressure chamber and toward the first end wall as water is discharged. An air pressure chamber is located on an opposite side of the moveable wall from the water pressure chamber and is pressurizable with compressed air to bias the moveable wall toward the first end wall. Preferably, an air pump is connected to the air pressure chamber for pressurizing the air pressure chamber with a user desired air pressure. A release valve is provided in fluid communication with the water pressure chamber. Actuation of the release valve allows a stream of water to be ejected from the nozzle due at least in part to the compressed air acting on the moveable wall.

In another aspect, the invention provides a toy water gun having a housing including a handle with a trigger and a water ejection nozzle located thereon. A water supply tank is connected to the housing and is filled with water. A water pump is located on the housing for pumping water from the supply tank to at least one water pressure chamber. The water pressure chamber includes a wall that is at least one of moveable and flexible. An air pressure chamber is located on an opposite side of the at least one of moveable and flexible wall from the water pressure chamber and is pressurizable with compressed air to apply an external force on the moveable and/or flexible wall. An air pressure source is preferably connected to the air pressure chamber for pressurizing the air pressure chamber with a user desired air pressure. A release valve is provided in fluid communication with the water pressure chamber so that actuation of the release valve allows a stream of water to be ejected from the nozzle due at least in part to the external force applied on the at least one of moveable and flexible wall.

This invention can be used, for example, in water guns having bladders in order to apply an additional force on the outside of the bladder, so that as the elasticity of the bladder material degrades over time or through use, a user can apply additional force at a desired level to either maintain or enhance the water gun performance.

The invention also has specific application in water guns that have a water chamber with a moveable wall in order to provide a user controlled amount of motive force to the water discharge.

BRIEF DESCRIPTION OF THE DRAWING(S)

The foregoing summary, as well as the following detailed description of the preferred embodiment of the present invention will be better understood when read in conjunction with the appended drawings. For the purposes of illustrating the invention, there is shown in the drawings an embodiment which is currently preferred. It should be understood, however, that the invention is not limited to the precise arrangement shown.

DETAILED DESCRIPTION OF THE PREFERRED EMBODIMENT(S)

Figure 1:
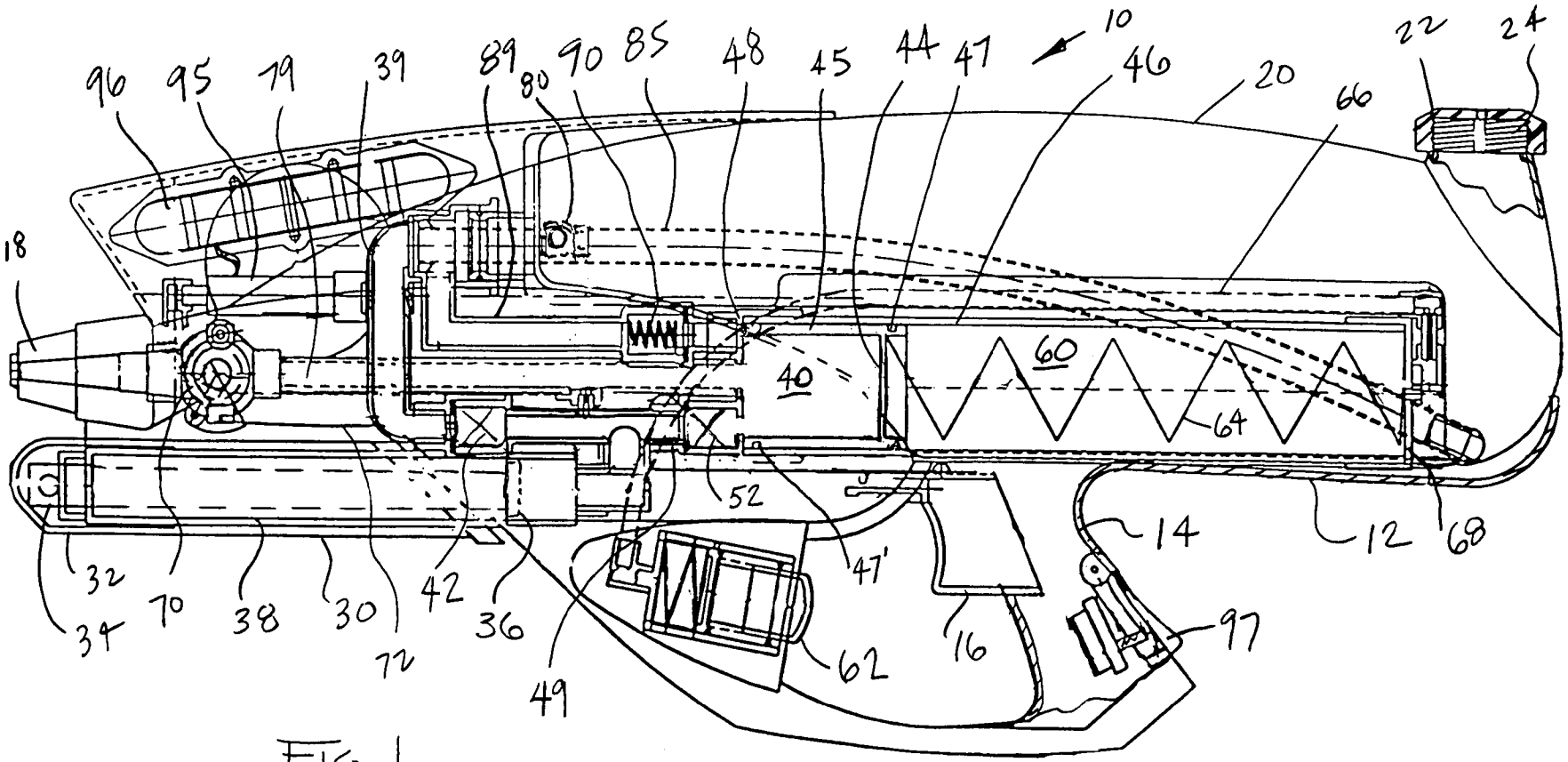
FIG. 1 is a side elevational view, partially broken away and partially shown in cross-section, showing a water gun in accordance with the present invention.
Figure 3:
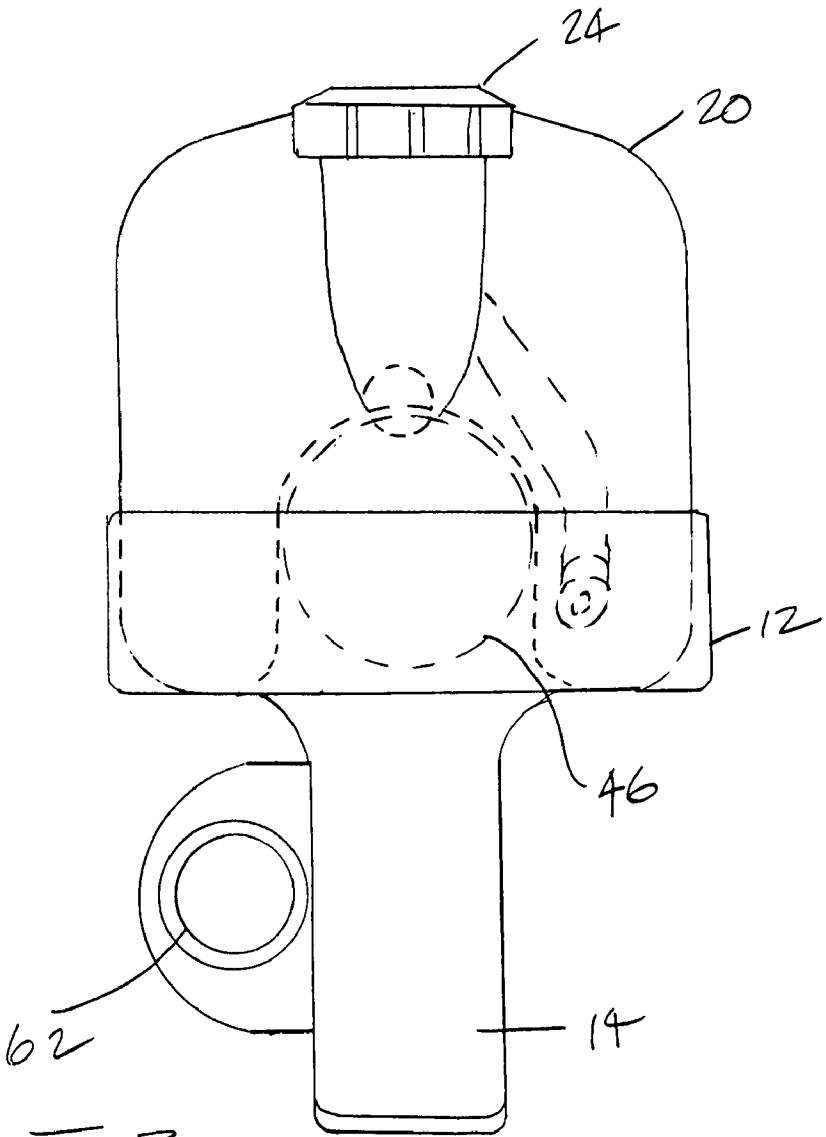
FIG. 3 is an end view taken along line 3—3 in FIG. 1.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the toy water gun shown and designated parts thereof. The terminology includes the words above specifically mentioned, derivatives thereof and words of similar import.

Figure 4:
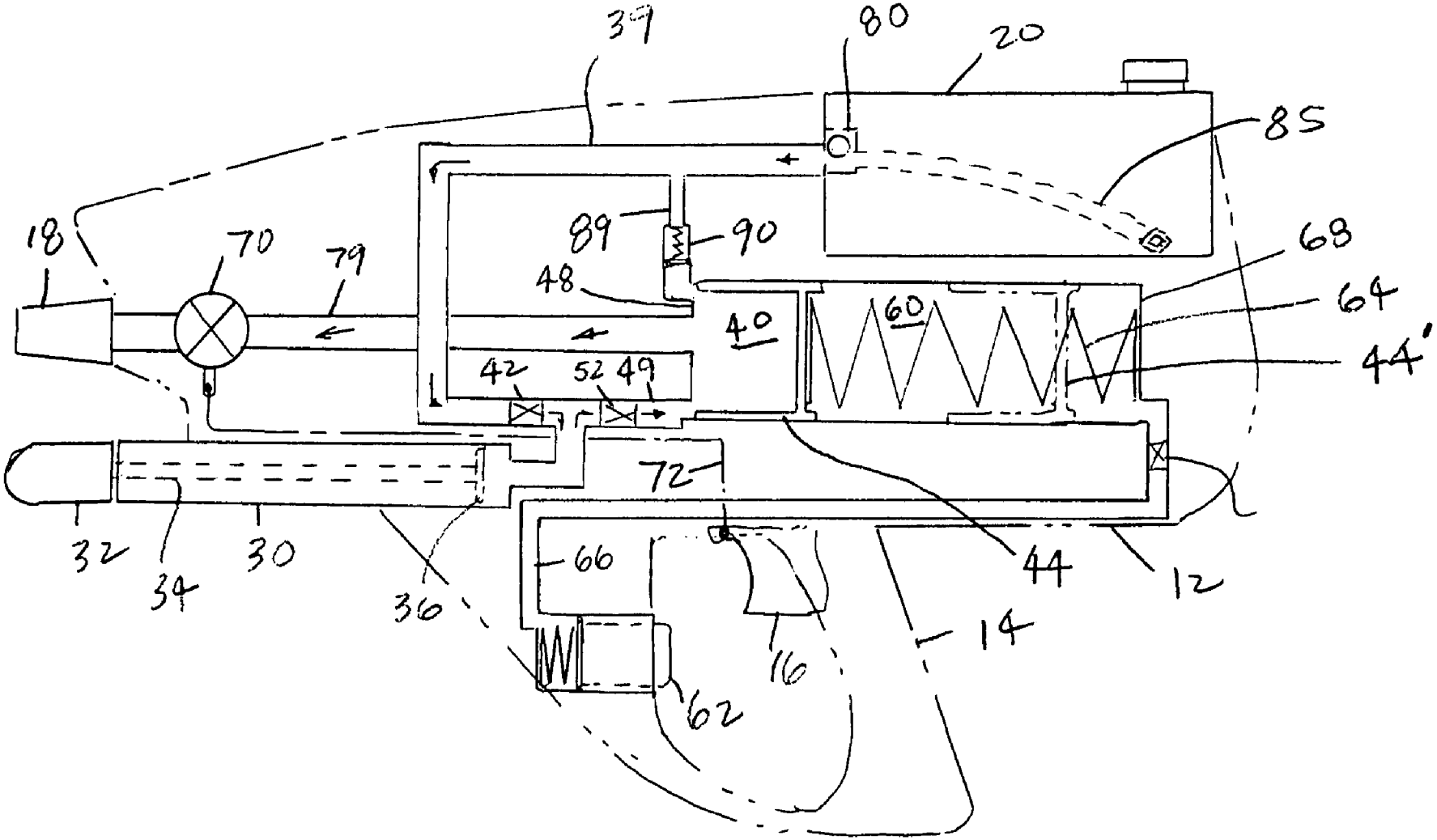
FIG. 4 is a side view, shown schematically to illustrate the functioning of the water gun in accordance with the present invention.

Referring now to FIGS. 1–4, a toy water gun 10 in accordance with the present invention is shown. FIG. 1 shows a preferred embodiment of the water gun 10, and FIG. 4 shows a schematicized diagram of the water gun 10 in which the functional parts and their interconnections are shown more clearly. The toy water gun 10 includes a housing 12 having a handle 14. A trigger 16 is located adjacent to the handle 14 and is preferably movable in order cause water to be ejected from a water ejection nozzle 18 located on the toy water gun 10. Preferably, the housing 12 and handle 14 are molded from a polymeric material. However, they can be made from other suitable materials, if desired. The trigger 16 is preferably slideably connected to the housing 12 so that it can be depressed linearly. However, it is also possible to provide a pivoting trigger 16. While the water ejection nozzle 18 is shown as being located at a front end of the water gun 10, it is possible for the nozzle 18 to be located at any of a variety of positions, or for a plurality of nozzles to be provided which can be selectively actuated.

A water supply tank 20 is connected to the housing 12 and is fillable with water. Preferably, the water supply tank 20 includes a fill cap 22 that is connected to the tank 20 via a threaded connection at the fill opening 24. A vent opening 26 is preferably provided in the fill cap 22.

A water pump 30 is preferably located on the housing 12 for pumping water from the supply tank 20 to at least one water pressure chamber 40. The water pump 30 preferably includes a handle 32 connected to a pump rod 34 having a pump seal 36 connected to one end which is reciprocated back and forth within a pump chamber 38 in order to draw water from the supply tank via a first conduit 39 into the pump chamber 38 during an outward stroke, and expels the water from the pump 30 to the water pressure chamber 40 during a return stroke. A check valve 42 is preferably located in the first conduit 39 and only allows the one-way flow of water from the supply tank 20 to water pump chamber 38. While a preferred embodiment of the pump 30 has been described, other types of water pumps can be utilized and the pump need not necessarily be attached to the housing 12.

The water pressure chamber 40 includes a wall 44 that is at least one of movable and flexible. The wall 44 shown in FIG. 1 is a movable wall and the water pressure chamber 40 includes at least one fixed wall 46 and a first end wall 48. The movable wall 44 substantially sealingly engages the at least one fixed wall 46 which is preferably tubular. The movable wall 44 is slidable away from the first end wall 48 as water is pumped by the water pump 30 into the water pressure chamber 40 via a second conduit 49. The second conduit 49 is preferably in communication with the pump 30 and, in the preferred embodiment, is also in communication with the first conduit 39, with back flow being prevented by the first check valve 42. A second check valve 52 is provided in the second conduit 49 to prevent back flow of water from the pressure chamber 40 to the pump 30. The movable wall 44 is also movable toward the first end wall 48 as water is discharged from the water pressure chamber 40.

Preferably, the movable wall 44 includes a collar 45 extending from a periphery thereof in a direction towards the first end wall 48. At least one seal 47 is located on the collar 45 and sealingly engages the at least one fixed wall 46. A second seal 47' can also be provided. The seals 47, 47' are preferably O-ring seals ,and the collar 45 preferably has a diameter slightly smaller then an inside diameter of the tubular fixed wall 46. This allows the movable wall 44 to slide back and forth while maintaining a seal between the water pressure 40 on one side and an air pressure chamber 60 located on an opposite side of the movable wall 44 from the water pressure chamber 40.

While the at least one fixed wall 46 is preferably a tubular wall with a circular cross section, other shapes of cross sections can be provided. For example, the at least one fixed wall 46 could comprise a rectangular or square cross section formed as a plurality of fixed walls. Additionally, the first end wall 48 can be integrally formed with the fixed wall or provided as a separate end cap, if desired. Preferably, the inlet and outlet connections to the water chamber 40 are provided on the first end wall 48.

The air pressure chamber 60 is pressurizable with compressed air to bias the movable wall 44 toward the first end wall 48. An air pump 62 is preferably connected to the air pressure chamber 60 for pressurizing the air pressure chamber 60 with a user desired air pressure. In the preferred embodiment, a spring 64 that biases the movable wall 44 toward the first end wall 48 is also provided. An air pressure hose 66 is preferably connected between the air pump 62 and the air pressure chamber 60, and is shown in dashed lines in FIG. 1. Preferably, a second end wall 68 is attached on an opposite end of the tubular fixed wall 46 from the first end wall 48, and the air pressure hose 66 is connected to the air pressure chamber 60 via an opening in the second end wall 68. While the preferred embodiment utilizes the air pump 62, it is also possible to use any type of air pressure source which is connected to the air pressure chamber 60 for pressurizing the air pressure chamber 60 with a user desired air pressure. The air pressure source can be, for example, an externally attachable air pump, or a pressurized air or $CO_2$ canister.

In the preferred embodiment, a user can press the pump 62, which is located in proximity to the handle 14, in order to add a desired amount of air pressure to the air pressure chamber 60. The air pressure can act alone, or in combination with the spring force of the spring 64 to hold the water in the water pressure chamber 40 under pressure.

A release valve 70 is provided in fluid communication with the water pressure chamber 40, preferably via an opening in the first end wall 48 connected to a third conduit 79. An actuating linkage 72, shown partially in FIG. 1 but more clearly in FIG. 4, is connected between the trigger 16 and the release valve 70. The release valve 70 is preferably a ball valve. However, other types of valves may be utilized, such as a pinch valve, plug valve or gate valve, or any other suitable type of release valve. Actuation of the release valve 70 allows a stream of water to be ejected from the nozzle 18 due at least in part to the external force provided by the compressed air in the air pressure chamber 60 acting on the movable wall 44.

By allowing a user to add a desired amount of air pressure to the air pressure chamber 60 via the pump 62, the force of the discharge of water from the nozzle 18 can be varied. Additionally, the force required to pump water from the water supply tank 20 into the water pressure chamber 40 can also be varied which would allow a smaller child to operate the water gun tank more easily, all be it with a reduced performance.

Figure 2:
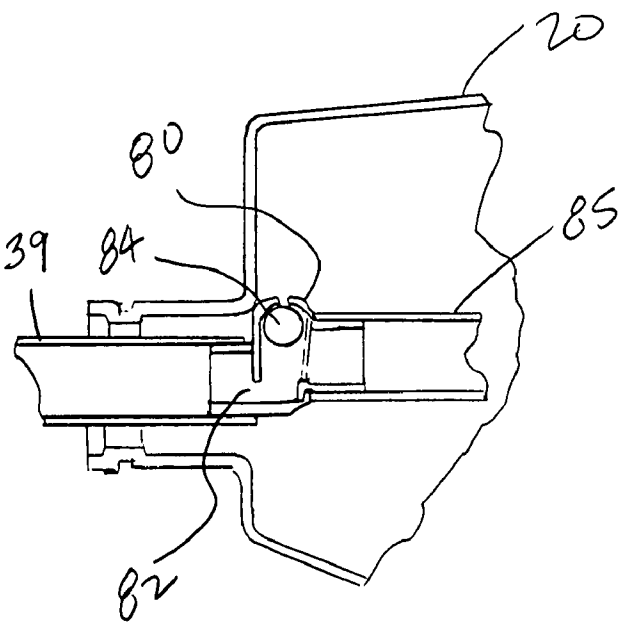
FIG. 2 is an enlarged portion from FIG. 1 showing the water supply float valve.

Referring to FIGS. 1 and 2, a float valve 80 is located in the water supply tank 20 that closes off an outlet 82 of the water supply tank 20 when it is substantially empty. The float valve 80 preferably includes a ball 84 which is light enough to float on the water drawn from the supply tank 20 through the suction tube 85 to the supply tank outlet and the first conduit 39. When no water is present in the supply tank 20, such that it is substantially empty, the ball 84 sinks down and closes off the valve seat 82 preventing air from being drawn into the pump and then forced into the water pressure chamber 40, which can degrade performance by causing additional turbulence as the water stream is ejected from the nozzle 18.

Preferably, the ball 84 is made of low density polyethylene. However, other suitable materials can be used. The float valve 80 is preferably oriented so that the ball 84 travels generally vertically when the water gun 10 is held in the use position. The valve will function properly even if the water gun 10 is tilted or rotated from side to side by up to about 80°. Further rotation may prevent the ball from seating.

Referring again to FIG. 1, preferably a fourth conduit 89 is connected between the water pressure chamber 40 and first conduit 39. A pressure relief valve 90 is located in the fourth conduit 89. The pressure relief valve 90 preferably includes a calibrated spring which maintains the relief valve 90 in a closed state until a maximum pressure in the water pressure chamber 40 is exceeded. In that case, the pressure relief valve 90 opens and allows water from the water pressure chamber 40 to be discharged back into the conduit 39 and to tank 20.

In the preferred embodiment, the toy water gun 10 includes a pressure gauge 95 which senses the pressure in the water pressure chamber 40. A visual pressure indicator 96 comprising a plurality of lights is connected to the pressure gauge 95 as well as to a switch 97 located at the back of the handle 14. Upon the user activating the switch 97, the pressure level is indicated by illuminating the visual indicators 96, which are preferably LED's, in order to indicate the pressure level.

While the first preferred embodiment of the invention has been described in terms of a fixed wall water pressure chamber 40 having one movable wall 44 which is shared in common with an air pressure chamber 60, it is also possible for the invention to be used in connection with a flexible wall, such as a wall of a rubber diaphragm or bladder of a bladder water gun. In this case, the air pressure chamber can surround the bladder, and the air pressure in the air pressure chamber can be varied by the user via an air pump. By increasing the air pressure, the performance of the bladder in the bladder water gun is enhanced due to the external force applied thereon.

Through the use of the combined spring 64 and air pressure in the air pressure chamber 60 acting as an external force on the water pressure chamber 40, the present invention provides a water gun 10 with enhanced performance which can be set to a desired level by a user. The invention also provides a solution to maintain the performance of a water gun, such as a bladder water gun, as the bladder performance degrades with time.

While the preferred embodiment of the invention has been described in detail, the invention is not limited to the specific embodiments described above, which should be considered as merely exemplary. Further modifications and extensions of the present invention may be developed, and all such modifications are deemed to be within the scope of the present invention as defined above and by the appended claims.

What is claimed is:

1. A toy water gun, comprising:

a housing including a handle with a trigger and a water ejection nozzle located thereon;

a water supply tank connected to the housing which can be filled with water;

a water pump located on the housing for pumping water from the supply tank to at least one water pressure chamber;

the water pressure chamber including at least one fixed wall, a first end wall, and a moveable wall which substantially sealingly engages the at least one fixed wall and is slidable away from the first end wall as water is pumped into the water pressure chamber and toward the first end wall as water is discharged;

an air pressure chamber located on an opposite side of the moveable wall from the water pressure chamber and being pressurizable with compressed air to bias the moveable wall toward the first end wall;

an air pump connected to the air pressure chamber for pressurizing the air pressure chamber with a user desired air pressure; and a release valve in fluid communication with the water pressure chamber so that actuation of the release valve allows a stream of water to be ejected from the nozzle due at least in part to the compressed air acting on the moveable wall.

2. The toy water gun of claim 1, further comprising a spring that biases the moveable wall toward the first end wall.

3. The toy water gun of claim 1, wherein the air pump is connected to the housing.

4. The toy water gun of claim 1, further comprising a first conduit connecting an outlet of the water supply tank to the water pump, and a float valve located in the water supply tank that closes the outlet when the water supply tank is substantially empty.

5. The toy water gun of claim 1, further comprising a first check valve located in a first conduit connecting an outlet of the water supply tank to the water pump, and a second check valve located in a second conduit connecting the water pump to the water pressure chamber.

6. The toy water gun of claim 1, further comprising a third conduit between the water pressure chamber and the release valve.

7. The toy water gun of claim 1, further comprising a fourth conduit connected between the water pressure chamber and the first conduit, and a pressure relief valve located in the fourth conduit.

8. The toy water gun of claim 1, further comprising a pressure gauge that senses a pressure in the water pressure chamber, and a visual pressure indicator connected to the pressure gauge.

9. The toy water gun of claim 1, wherein the at least one fixed wall is a tubular wall, and the moveable wall is slidable within the tubular wall, the air pressure chamber is formed by the tubular wall, the moveable wall and a second end wall connected to an opposite end of the tubular wall from the first end cap.

10. The toy water gun of claim 1, wherein the water pressure chamber expands by movement of the moveable wall as water is pumped into the water pressure chamber, and the air pressure chamber is simultaneously reduced in size.

11. The toy water gun of claim 1, wherein the moveable wall includes a collar extending from a periphery thereof in a direction toward the first end cap, and at least one seal is located on the collar that sealingly engages the at least one fixed wall.

12. A toy water gun, comprising:

a housing including a handle with a trigger and a water ejection nozzle located thereon;

a water supply tank connected to the housing which can be filled with water;

a water pump located on the housing for pumping water from the supply tank to at least one water pressure chamber, the water pressure chamber having a wall that is at least one of moveable and flexible;

an air pressure chamber located on an opposite side of the at least one of moveable and flexible wall from the water pressure chamber and being pressurizable with compressed air to apply an external force on the moveable and/or flexible wall;

an air pressure source connected to the air pressure chamber for pressurizing the air pressure chamber with a user desired air pressure; and a release valve in fluid communication with the water pressure chamber so that actuation of the release valve allows a stream of water to be ejected from the nozzle due at least in part to the external force applied on the at least one of moveable and flexible wall.

13. The toy water gun of claim 12, further comprising a spring acting on the at least one of moveable and flexible wall.

14. The toy water gun of claim 12, wherein the water pressure chamber is one of a flexible bladder or a chamber having at least one fixed wall and a moveable wall that can be moved to expand or contract a volume of the chamber.

15. The toy water gun of claim 12, wherein the water pressure chamber is formed by the at least one fixed wall, an end wall connected thereto and the moveable wall, and the air pressure source is an air pump connected to the water gun housing.

* * * * *

UNITED STATES PATENT AND TRADEMARK OFFICE

CERTIFICATE OF CORRECTION

PATENT NO. : 7,097,073 B2
APPLICATION NO. : 10/679809
DATED : August 29, 2006
INVENTOR(S) : Jeffrey C. Zimmerman It is certified that error appears in the above-identified patent and that said Letters Patent is hereby corrected as shown below:

Col. 3, line 14, after “order”, insert --to--.

Col. 4, line 2, delete “then” and insert therefor --than--.

Signed and Sealed this

Thirty-first Day of July, 2007

JON W. DUDAS
*Director of the United States Patent and Trademark Office*